United States Patent [19]

Steiger

[11] 4,413,482

[45] Nov. 8, 1983

[54] CAM-SUPPORT FOR A KNITTING MACHINE

[75] Inventor: Gerard Steiger, Montreux, Switzerland

[73] Assignee: Atelier de Construction Steiger S.A., Switzerland

[21] Appl. No.: 270,966

[22] Filed: Jun. 5, 1981

[30] Foreign Application Priority Data

Jun. 16. 1980 [CH] Switzerland ..... 4608/80

[51] Int. Cl.[3] ..... D04B 7/00

[52] U.S. Cl. ..... 66/78; 66/75.1

[58] Field of Search ..... 66/78, 70, 57, 75.1, 66/40, 42, 75.2

[56] References Cited

U.S. PATENT DOCUMENTS

| | | | |
|---|---|---|---|
| 236,062 | 12/1880 | Moore | 60/75.1 |
| 242,129 | 5/1981 | Howard | 66/75.1 |
| 1,992,982 | 3/1935 | Zippel | 66/75.2 |

FOREIGN PATENT DOCUMENTS

| | | | |
|---|---|---|---|
| 711199 | 1/1980 | U.S.S.R. | 66/78 |

*Primary Examiner*—Ronald Feldbaum

*Attorney, Agent, or Firm*—Kane, Dalsimer, Kane, Sullivan and Kurucz

[57] ABSTRACT

A cam-support for a knitting machine for the entrainment of the push-rods, respectively of the needles, according to the so-called "three-way" technique, having first, second and third lifting cams intended to entrain the abutment surfaces of the push-rods, respectively of the needles, at several different selection points, so that the needles operate either for shaping, or for picking up or so that they do not operate. The first and second lifting cams are located one beside the other and the third lifting cam is located between them but is separated therefrom by a first channel between the first and third cams and by a second channel between the second and third cams. The channels merge in an empty space between all three cams. A push-rod selected before the arrival of an outer or leading end of one of the first or second cams is entrained by this cam and by the third cam and operates in the knit position, whereas a push-rod selected opposite the empty space is not entrained by the third cam and operates in the tuck position. The three lifting cams may be fixed.

1 Claim, 2 Drawing Figures

CAM-SUPPORT FOR A KNITTING MACHINE

The present invention relates to a cam-support for a knitting machine for the entrainment of the push-rods, respectively of the needles, according to the so-called "three way" technique, comprising several lifting cams intended to entrain the abutment surfaces of the push-rods respectively of the needles, at several different selection points, so that the needles operate either in the knit tuck or miss position.

In order to produce different patterns when knitting, it is well known to provide three methods of operation of the needles, namely a first method of operation "for knitting", where the needle undergoes a relatively considerable displacement allowing the stitch to slide beyond the latch of the needle, or a second method of operation "for tucking", where the needle undergoes a lesser displacement facilitating the taking-up of a new stitch without closure of the latch, or, finally, a third "or missing" method in which the needle is not entrained by the knitting cams. To this end, it is known from German patent application No. 24 44 046 to use push-rods provided with an abutment surface allowing their retraction by means of a special cam comprised by the cam-support. A machine equipped in this way has virtually no flexibility of use and the possibilities of producing different patterns are limited.

On the other hand, French Pat. No. 1 500 569 describes a cam-support comprising two pairs of lifting cams intended to cooperate with the abutment surfaces of the push-rods for the two directions of movement of the cam-support respectively. The push-rods are preselected in order to be entrained either by the first cam, in order to raise the needles which are entrained by cams in order to operate in the knit position, or to pass below the first cam in order to be released in front of the second cam, in order to be entrained by this second cam by raising the needles which are entrained by a cam in order to operate in the tuck position. This cam-support also comprises two movable cams cooperating with the abutment surfaces of the needles, one of these cams being able to move longitudinally and the other to rotate in the opposite direction to the action of the abutment surfaces of the needles. However, this cam-support cannot be used in a double system knitting machine, on account of the system for the selection of the push-rods. In fact, once the push-rods have been selected, they cannot be selected a second time at the time of the same passage of the carriage.

Furthermore, the Applicant has developed an electromechanical device for individual selection of the needles facilitating a very rapid selection of the needles by means of a device mounted on the cam-support carriage and comprising electromagnets controlling ratchets. This device is described in particular in French Pat. No. 2 436 207.

The present invention intends to take advantage of the rapidity, flexibility and of the possibilities of remotely controlling this selection device by means of a programme recorded on a magnetic tape or other recording support, in order to produce a cam-support which is as simple and compact as possible making it possible to produce a multiple system knitting machine, without any limitations.

To this end, the cam-support according to the invention is characterised by the fact that it comprises at least one arrangement of lifting cams comprising two lifting cams located immediately one after the other and each comprising two opposed ramps and a third lifting cam located between the adjacent ramps of the two first cams, an empty space being provided below this third cam, said space being connected to two channels limited on one side by the adjacent ramps of the two first cams, so that a push-rod, respectively a needle, selected before the arrival of an outer end of said first cams, is entrained by one of said first cams in the direction of movement of the cam-support and by the third cam and operates in the knit position. Whereas a push-rod, respectively a needle, selected when said empty space arrives approximately opposite said push-rod, respectively needle, is not entrained by the third cam and operates in the tuck position.

One thus obtains a very short arrangement of cams, measured in the direction of movement of the carriage. This arrangement can be repeated several times since the selection of the push-rods is instantaneous and takes place to some extent at random. It is thus possible to select the same key several times in succession at the time of a single passage of the carriage, which makes it possible to repeat the pattern.

Since the carriage is more compact, it is possible to reduce its travel and consequently to increase production.

In the case where push-rods are used, the entire three-way selection is effected exclusively by means of the abutment surface of the push-rods, which makes it possible to use the abutment surface of the needle for transferring stitches, whereas by means of the cam-support according to the prior art, the transfer of stitches has to be effected by means of cams disposed at the side of the cams illustrated, which requires an additional movement of the carriage. With the exception of the cams necessary for the transfer of stitches, all the cams can be fixed. The lifting cams are able to move in two directions.

In known machines, the needles are pushed by push-rods and it is the abutment surfaces of these push-rods which are or are not engaged, at right angles to the plane of the cam-support, in the trajectory of the cams, but it would be possible to dispense with the push-rods for selecting the needles directly in the manner of the pins. Furthermore, this type of cam-support may be used both with a circular knitting machine as well as with a straight knitting machine.

The accompanying drawings illustrate one embodiment of the invention by way of example.

Figure 1:
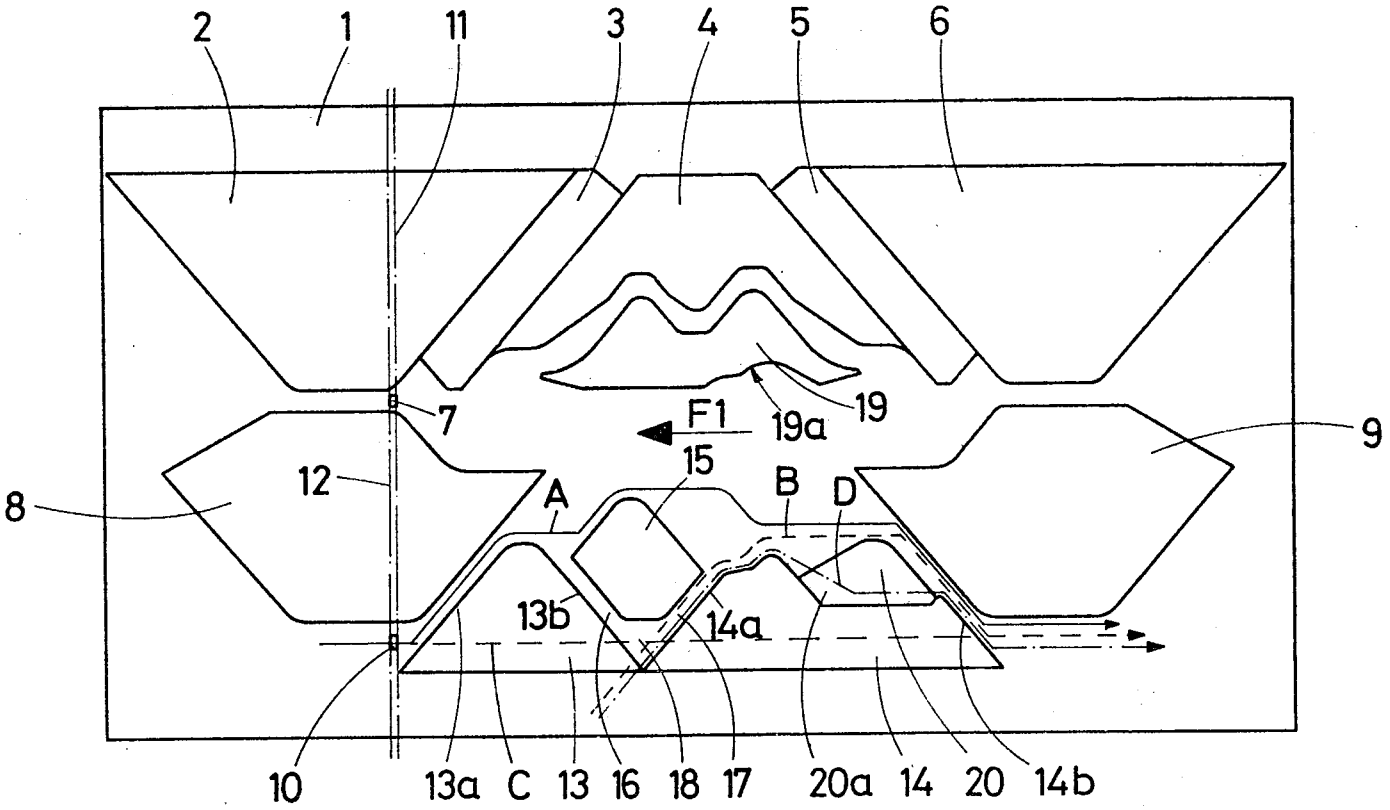
FIG. 1 shows a cam-support as well as the various possible trajectories of the push-rods at the time of movement of the cam-support from right to left.

The cam-support illustrated is intended to be mounted, in manner known per se, on a carriage moving along a needle row containing needles and push-rods, the needle row or rows are also accompanied by an auxiliary needle row perpendicular to the main needle row and containing auxiliary push-rods intended to cooperate with a selection device, such as that described in French Pat. No. 2 436 207.

The cam-support is constituted by a plate 1 on which knitting cams are mounted in manner known per se. The cams 2 to 6 are fixed cams intended to cooperate with the abutment surfaces 7 of the needles. The cams 8 and 9 which are also fixed cooperate on the one hand with the abutment surfaces of the needles for their alignment and on the other hand with the abutment surfaces 10 of the push-rods for their knocking-over. One position of a needle 11 and its associated push-rod 12 has been illustrated by way of example, in dot dash line. The cam-support also comprises two lifting cams 13 and 14 which are fixed and each comprise two main opposed ramps 13*a*,13*b* respectively 14*a* and 14*b*, these cams 13 and 14 being located one beside the other, so that the lower ends of the ramps 13*b* and 14*a* join. However, they could be separated by a short space. A third lifting cam 15 which is also fixed is mounted between the two cams 13 and 14. This cam 15 is separated from the cams 13 and 14 by two channels 16 and 17 joining in an empty space 18, above the junction point of the cams 13 and 14.

All the cams mentioned above are fixed. The cam-support illustrated is also equipped with a system for transferring stitches and to this end comprises a cam 19, for the needles, able to be put into or out of operation, in manner known per se, by moving at right angles to the plane of the drawing and a cam 20, which is also movable, which may be either a cam which is able to be put into or out of operation or an automatic cam which can be retracted by the abutment surface of the push-rods, when the cam-support moves from right to left, in the direction of arrow F1, the cam 20 comprising a ramp 20*a* on its side for this purpose.

Considering FIG. 1, let us assume that the illustrated abutment surface 10 of the push-rod 12 is selected, i.e. pushed out of its needle row, at the instant when the cam 13 arrives in the vicinity of this abutment surface 10. This abutment surface will thus be entrained by the cams 13 and 15 along trajectory A. The associated needle thus operates "in the knit position".

If the selection of the push-rod 12 takes place solely when the latter is located opposite the space 18, its abutment surface is raised by the ramp 14*a* of the cam 14, without passing over the cam 15. The associated needle thus rises to a lesser extent and operates "in the tuck position". The pin follows the trajectory B approximately. The selection mechanism is fully disclosed in the aforementioned French Pat. No. 2,436,207, and the corresponding British Pat. No. 2,029,867B, incorporated herein by reference.

Finally, if the push-rod is not selected, i.e. that it remains in its needle row and that its abutment surface 10 is not pushed into the trajectory of the cams, the push-rod is inoperative and its trajectory C is rectilinear. It is obvious that when one speaks of a trajectory, one considers the relative movement of the pins with respect to the cam-support.

If the cam 19 is operative, the push-rod, selected opposite the space 18, follows the trajectory D approximately, the needle being guided by the ramp 19*a*. The needle thus operates for transferring a stitch (needle which picks up). The cam 20 is thus inoperative, i.e. retracted, according to its design.

Figure 2:
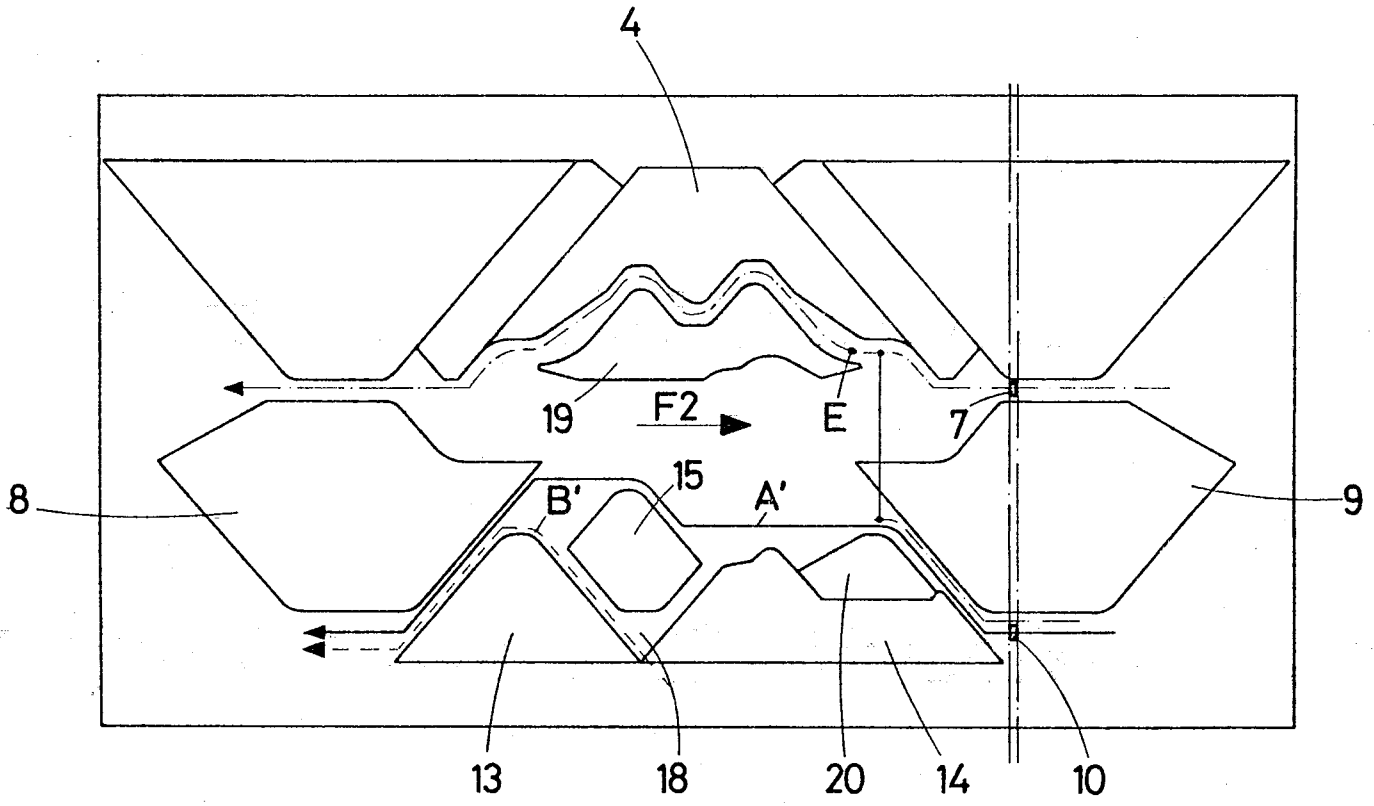
FIG. 2 shows the same cam-support and the possible trajectories of the push-rods at the time of movement of the cam-support from left to right.

When the cam-support moves in the other direction, according to arrow F2, as illustrated in FIG. 2, the push-rod follows one of the trajectories illustrated in this figure. If the selection takes place at the end of the cam 14, the abutment surface 10 of the push-rod follows the trajectory A' and the needle operates "in the knit position". If the selection takes place solely opposite the space 18, the abutment surface 10 follows the trajectory B' and the needle operates "in the tuck position". If the push rod is not selected, it is not entrained by the cams. If, when the push-rod is selected on reaching the cam 14, the cam 19 is operative, the abutment surface 7 of the needle is completely engaged by the cams 4 and 19 and follows the trajectory E. The needle thus operates for transferring (needle which gives up stitches).

What is claimed is:

1. A cam support for a knitting maching for the entrainment of push-rods, respectively of the needles, according to the so-called "three way" technique, comprising several lifting cams intended to entrain the abutment surfaces of the push-rods, respectively of the needles, at several different selection points, so that the needles operate either in a knit, tuck or miss position, characterised by the fact that it comprises at least one arrangement of lifting cams comprising two lifting cams arranged immediately one after the other and each comprising two opposed ramps and a third lifting cam disposed between the adjacent ramps of the of the two first cams, an empty space being provided below this third cam, said space being connected to two channels limited on one side by the adjacent ramps of the first two cams, so that a push-rod, respectively of a needle, selected before the arrival of an outer end of said first cams, is entrained by one of the said first cams, in the direction of movement of the cam-support and by the third cam and operates in the knit position, whereas a push-rod, respectively of a needle, selected when said empty space arrives approximately opposite said push-rod, respectively of a needle, is not entrained by the third cam and operates in the tuck position.

* * * * *